United States Patent [19]

Lindgren

[11] Patent Number: 4,485,614

[45] Date of Patent: Dec. 4, 1984

[54] ROTATABLE FLYER

[75] Inventor: Mats E. G. Lindgren, Vikmanshyttan, Sweden

[73] Assignee: AB Kompositprodukter S.K.F.M., Vikmanshyttan, Sweden

[21] Appl. No.: 422,899

[22] PCT Filed: Jan. 13, 1982

[86] PCT No.: PCT/SE82/00007

§ 371 Date: Sep. 9, 1982

§ 102(e) Date: Sep. 9, 1981

[87] PCT Pub. No.: WO82/02454

PCT Pub. Date: Jul. 22, 1982

[30] Foreign Application Priority Data

Jan. 13, 1981 [SE] Sweden ..... 8100144

[51] Int. Cl.[3] ..... D07B 3/12; D01H 7/86

[52] U.S. Cl. ..... 57/58.52; 57/115; 57/58.63

[58] Field of Search ..... 57/58.34, 58.36, 58.38, 57/58.52, 58.63, 58.83, 115, 116, 249

[56] References Cited

U.S. PATENT DOCUMENTS

| | | | |
|---|---|---|---|
| 3,793,819 | 2/1974 | Madalozzo et al. | 57/58.52 |
| 3,812,666 | 5/1974 | Sarracino | 57/58.52 |
| 3,945,182 | 3/1976 | Dover et al. | 57/115 X |
| 4,159,618 | 7/1979 | Sokaris | 57/249 X |
| 4,302,924 | 12/1981 | Faulstich | 57/58.52 |
| 4,339,909 | 7/1982 | Godderidge | 57/58.52 |
| 4,384,447 | 5/1983 | Faulstich | 57/58.52 |

FOREIGN PATENT DOCUMENTS

| | | |
|---|---|---|
| 379837 | 10/1975 | Sweden . |
| 374310 | 2/1964 | Switzerland . |
| 14575 | of 1914 | United Kingdom . |
| 722206 | 1/1955 | United Kingdom . |

*Primary Examiner*—Donald Watkins

*Attorney, Agent, or Firm*—Fleit, Jacobson Cohn & Price

[57] ABSTRACT

An annular or closed loop rotatable frame or 'flyer' (1), such as is used in a stranding machine of type, in which two or more wires, fibres or strands are stranded to a cable, e.g. intended for telecommunication, the flyer being arranged to rotate around one or more bobbins (10, 11). The frame (1) is journalled in two diametrically opposite points (8, 22) and is prestressed at these two journal points in a direction perpendicular to the centrifugal force produced by the rotation. In this way a bending moment in the opposite direction is produced making it possible to increase the speed of rotation of the flyer.

6 Claims, 3 Drawing Figures

FIG. 1
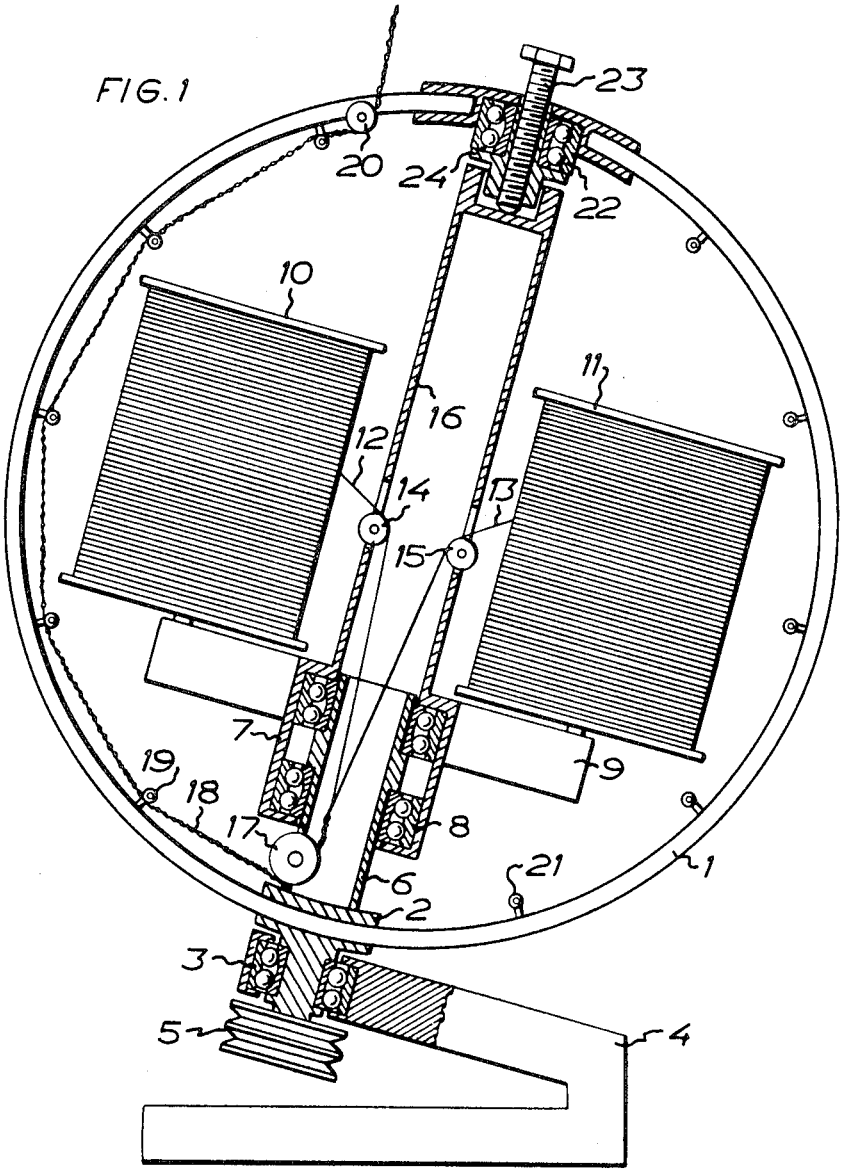
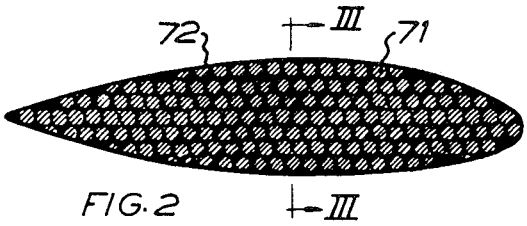
FIG. 2
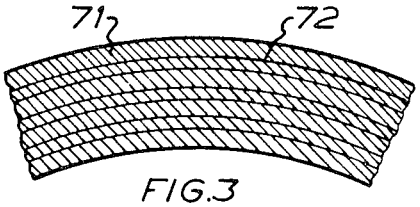
FIG. 3

ROTATABLE FLYER

TECHNICAL FIELD

The invention relates to an annular or closed loop rotatable frame or "flyer" such as is used in a stranding machine of the type, in which two or more wires, fibres or strands are stranded to a cable, e.g. intended for stranding insulated conductors e.g. for the production of cables for telecommunication, the flyer being arranged to rotate around one or more bobbins.

BACKGROUND ART

At a known stranding machine for stranding two or more wires or fibres a flyer is rotatable around a shaft and two or more wire bobbins are suspended within the orbit of the flyer on a suspension device rotatably supported by the flyer shaft and thus not taking part in the rotation of the flyer. From the bobbins the wires are passed down into the hollow shaft of the flyer, where they are stranded to a cable, which is further passed to a tape applicating machine, or to a capstan. In order that the bobbins shall not take part in the rotation of the flyer, the suspension means are constructed and loaded in such a way that their centre of gravity is outside the flyer shaft axis or its elongation, which in addition diverges from the vertical.

Owing to the rotation the flyer is subjected to centrifugal forces that limit the stranding speed. In order to give the flyer better strength against these centrifugal forces, it has been tried to design the flyer as a preferably circular frame. But even for such a frame the rotation speed is limited, depending on the allowable stress of the material and depending on the air resistance of the rotating flyer.

DISCLOSURE OF THE INVENTION

According to the present invention the speed of a flyer constructed as an annular frame can be further increased by journalling the frame in two diametrically opposite points and prestressing the flyer by stretching it at these two points. It will then be prestressed by a bending moment in the plane of the flyer in a direction perpendicular to the centrifugal force produced by the rotation of the flyer. The prestressing force may at most produce the maximum acceptable bending moment in the flyer. When the flyer rotates a bending moment in the opposite direction is developed and may thus be two times the bending moment that can be accepted without prestressing. It has been shown that for a circular flyer and a safety coefficient of 3.5 it is possible to allow a speed of rotation which is 25% higher than without prestressing the flyer.

In order to gain the optimal speed the flyer according to the invention ought to be made as thin as possible and aerodynamically shaped whereby the air resistance and noise decrease, but at the same time having high rigidity and low natural frequency. It is especially preferable to use rings of fibre reinforced plastics, e.g. carbon fibre reinforced epoxy resin with continuously wound fibres in tangential i.e. circumferential direction.

In order to produce the prestressing the flyer is mounted at diametrically opposite points in bearings, that can stand axial forces. Further advantages of the flyer are achieved by embodiments given in the claims.

BRIEF DESCRIPTION OF THE DRAWING AND A PREFERRED EMBODIMENT OF THE INVENTION

The invention is to be described in more detail referring to the attached drawing in which:

FIG. 1 shows an embodiment with two bobbins inside the flyer,

FIGS. 2 and 3 show in cross section and longitudinal section respectively a flyer of the preferred material, carbon fibre placed in circumferential direction and bound with epoxy resin.

According to FIG. 1 an annular flyer 1 is fastened to a shaft 2 and journalled 3 in a rack 4. The other end of the shaft is equipped with a driving gear 5. Inside the flyer the shaft is extended by a tube 6 on which a stand 9 for the bobbins 10, 11 is journalled, 7, 8. By eccentric suspension of the bobbins or in any other way it is ensured that the centre of gravity of the stand always is below the inclined centre line of the shaft. From the bobbins 10, 11 two wires 12, 13 are passed over pulleys 14, 15 mounted in a socket 16, projecting from the stand 9, to a wheel 17 attached to the tube 6, which is fixed to the shaft 2 of the flyer. Because this wheel 17 follows the flyer when it rotates the wires 12, 13 are twisted before the wheel. The twisted cable 18 is passed along the inside of the flyer by pulleys 19 or nipples and leaves the flyer over a wheel 20. In order to prevent unbalance of the flyer also the other half of the flyer is equipped with pulleys 21 or appropriate counterweights. When the flyer rotates the centrifugal force tends to give it an elliptic form. This causes bending stresses at the fastening points of the shaft 2. This flexural stress is counteracted by journalling 22 the flyer on the socket 16 projecting from the stand 9 at the intersection point between the flyer and the extension of the centre line of the shaft.

According to the invention the flexural stress of the flyer can be further diminished by prestressing the flyer in the direction of the shaft. According to the embodiment shown this is performed with a screw 23 and a socket 24 by the help of which the flyer may be extended in the direction of the shaft. The bearings 3, 7, 8, 22 are constructed so that they can stand axial stresses arising at the prestressing. The extension of the flyer in the shaft direction produces a bending moment in a direction opposite to the bending moment produced by the centrifugal force when the flyer rotates. Consequently much higher centrifugal forces may be allowed before the bending moment in the fastening points of the flyer reaches an unallowable value.

In FIGS. 2 and 3 are shown a cross section and a longitudinal section respectively of a flyer of the preferred embodiment comprising monofil carbon fibres 71 bound by epoxy resin 72.

I claim:

1. A rotatable flyer for use in a stranding machine in which two or more wires, fibers or strands are stranded together or to a cable, said flyer comprising: an annular frame; support means for rotatably supporting said frame for rotation about an axis of rotation passing through diametrically opposed points and said frame; and means carried by said frame to prestress said frame in a direction perpendicular to the centrifugal force produced by the rotation.

2. A flyer according to claim 1, wherein said frame is made of fiber reinforced plastic with continuous fibers arranged circumferentially.

3. A flyer according to claim 1, wherein said support means includes two journalling points arranged on a driving shaft on which said frame is carried and on a socket journalled to the driving shaft.

4. A flyer according to claim 1, wherein the frame is aerodynamically shaped to minimize noise and air resistance.

5. A flyer according to claim 2, wherein said fibers are carbon fibers bound together by epoxy resin.

6. A flyer according to claim 2 or 5, wherein the fiber is wound continuously in a plurality of turns along the frame.

* * * * *